US012759829B1

(12) United States Patent
Corrigan

(10) Patent No.: US 12,759,829 B1
(45) Date of Patent: Oct. 13, 2026

(54) ADAPTIVE DISPENSER FOR EXPANDABLE SLIT SHEET MATERIAL

(71) Applicant: 3M INNOVATIVE PROPERTIES COMPANY, St. Paul, MN (US)

(72) Inventor: Thomas R. J. Corrigan, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 105 days.

(21) Appl. No.: 18/755,799

(22) Filed: Jun. 27, 2024

Related U.S. Application Data

(60) Provisional application No. 63/526,714, filed on Jul. 14, 2023.

(51) Int. Cl.
*B65H 23/188* (2006.01)
*B65H 16/00* (2006.01)

(52) U.S. Cl.
CPC ..... *B65H 23/188* (2013.01); *B65H 16/005* (2013.01); *B65H 2301/5124* (2013.01); *B65H 2403/00* (2013.01); *B65H 2513/11* (2013.01)

(58) Field of Classification Search
CPC ..... B65H 23/188; B65H 16/005; B65H 2301/5124; B65H 2513/11
See application file for complete search history.

(56) References Cited

U.S. PATENT DOCUMENTS

| | | | | |
|---|---|---|---|---|
| 9,701,091 | B2 * | 7/2017 | Page | B65H 23/06 |
| 2018/0236742 | A1 * | 8/2018 | Cheich | B31D 5/0065 |
| 2018/0281336 | A1 * | 10/2018 | Cheich | B31D 5/0065 |
| 2020/0016860 | A1 * | 1/2020 | Cheich | B31D 5/0065 |
| 2020/0239259 | A1 * | 7/2020 | Page | B65H 23/06 |
| 2020/0247080 | A1 * | 8/2020 | Cheich | B65H 16/106 |

* cited by examiner

*Primary Examiner* — Sang K Kim
(74) *Attorney, Agent, or Firm* — Bryan L. Walker

(57) ABSTRACT

A dispenser for a roll of sheet material having expandable slits includes side support members, an input roller movably and rotatably coupled to the side support members configured to apply an input loading force onto the roll in a direction at least partially toward a loaded position for the roll, and an output roller rotatably coupled to the side support members. The dispenser may include a drive system coupling rotation of the input roller and the output roller to define a velocity ratio greater than 1.1. The dispenser may have multiple positions configured to accommodate various roll weights and diameters as the roll is consumed. The dispensed may be used to deploy sheet material by expanding slits in the sheet material.

14 Claims, 7 Drawing Sheets

ADAPTIVE DISPENSER FOR EXPANDABLE SLIT SHEET MATERIAL

The present disclosure relates to a dispenser for sheet material rolls and, in particular, an adaptive dispenser for sheet material rolls of tension-activated, expandable sheet material.

SUMMARY

In one aspect, a dispenser for a roll of sheet material having expandable slits includes side support members. The side support members include a first side support member and a second side support member spaced along a width axis, each defining a material support interface configured to guide a material support member to a loaded position. The dispenser includes an input roller movably and rotatably coupled to the side support members configured to engage the roll when the roll is mounted onto the material support member in the loaded position and configured to apply an input loading force onto the roll in a direction at least partially toward the loaded position. The dispenser includes an output roller rotatably coupled to the side support members. The output roller is spaced from the input roller along a draw direction orthogonal to the width axis. The output roller is positioned to engage unrolled sheet material from the roll extending from the input roller. The dispenser includes a drive system configured to couple rotation of the input roller and the output roller such that a velocity ratio of the output roller to the input roller is greater than 1.1 to expand slits in the sheet material.

In another aspect, a dispenser for a roll of sheet material having expandable slits includes side support members including a first side support member and a second side support member spaced along a width axis, each defining a material support interface configured to guide a material support member to a loaded position. The dispenser includes an input roller movably and rotatably coupled to the side support members configured to engage the roll when the roll is mounted onto the material support member in the loaded position. The dispenser includes an output roller rotatably coupled to the side support members. The output roller is spaced from the input roller along a draw direction orthogonal to the width axis. The output roller is positioned to engage unrolled sheet material from the roll extending from the input roller. In a first position, the input roller is configured to apply a first input loading force onto the roll in a first direction at least partially toward the loaded position, the first direction at a first angle to a length axis. In a second position, the input roller is configured to apply a second input loading force onto the roll in a second direction at least partially toward the loaded position, the second direction at a second angle to the length axis less than the first angle. In a third position, the input roller is configured to apply a third input loading force onto the roll in a third direction at least partially toward the loaded position, the third direction at a third angle to the length axis less than the second angle.

In yet another aspect, a method of dispensing a roll of sheet material having expandable slits includes disposing the roll of sheet material into the loaded position of the dispenser; engaging the input roller with the roll of sheet material; engaging unrolled sheet material with the output roller; and deploying unrolled sheet material into expanded sheet material.

BRIEF DESCRIPTION OF VIEWS OF THE DRAWINGS

To easily identify the discussion of any particular element or act, the most significant digit or digits in a reference number refer to the figure number in which that element is first introduced.

DESCRIPTION

Figure 1:
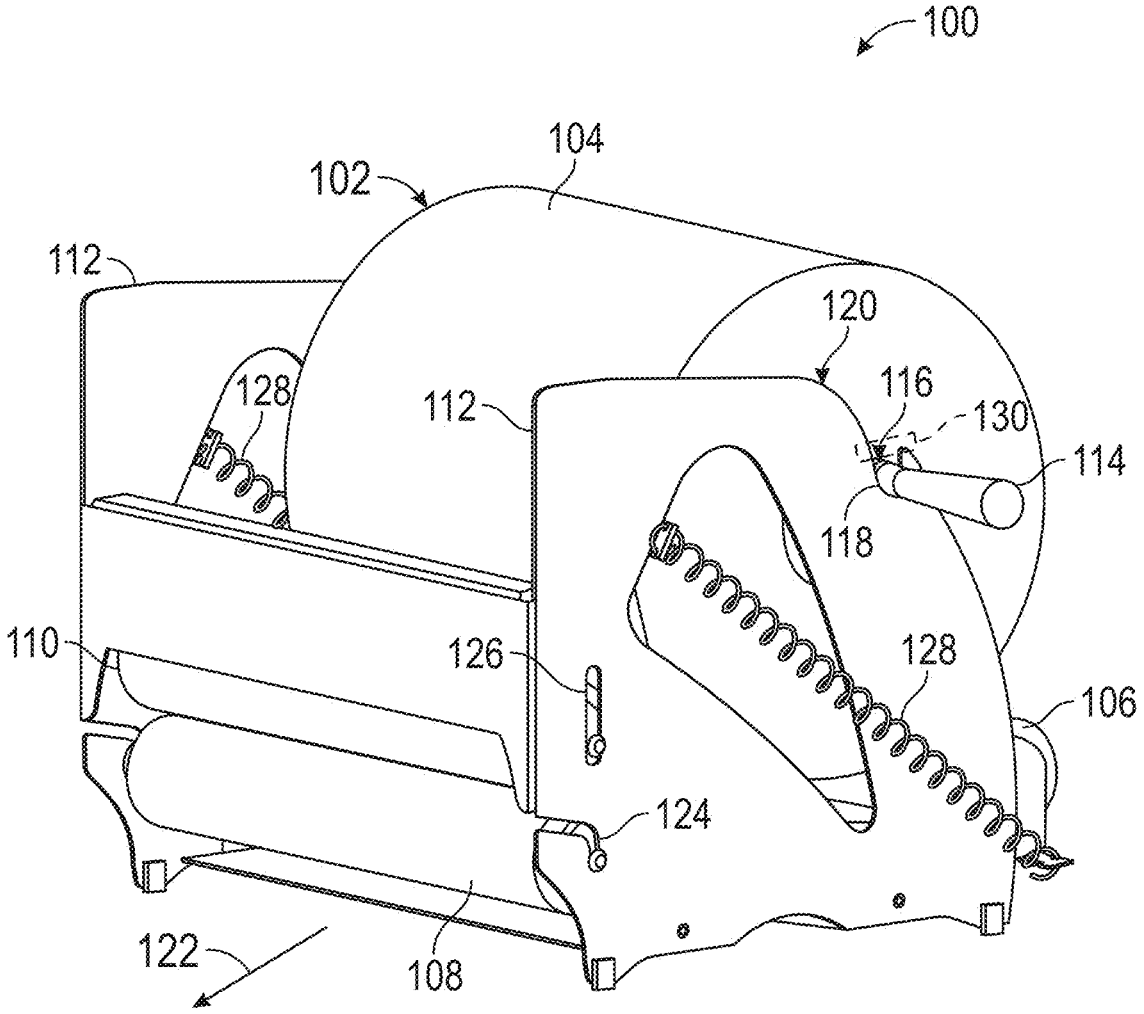
FIG. 1 illustrates a perspective view of a dispenser for use with a roll of sheet material in accordance with one embodiment.

"Paper" as used herein refers to woven or non-woven sheet-shaped products or fabrics (which may be folded and may be of various thicknesses) made from cellulose (particularly fibers of cellulose, whether naturally or artificially derived) or otherwise derivable from the pulp of plant sources such as wood, corn, grass, rice, and the like. Paper includes products made from both traditional and non-traditional paper making processes, as well as materials of the type described above that have other types of fibers embedded in the sheet, for example, reinforcement fibers. Paper may have coatings on the sheet or on the fibers themselves. Examples of non-traditional products that are "paper" within the context of this disclosure include the material available under the trade designation TRINGA from PAPTIC (Espoo, Finland), and sheet forms of the material available under the trade designation SULAPAC. Paper also includes extensible and semi-extensible papers, such as the material available under the trade designation TEA-KRAFT from WestRock Company (Atlanta, GA).

In this disclosure, "Minimum Pull Force Per Meter" is determined according to the test method described herein. Unless otherwise specified, the width refers to the width of the expandable sheet material, that is, the dimension orthogonal to the draw direction and the direction which expandable sheet material is wound.

The term "expandable sheet material" refers to sheet material having expandable slits, which may be activated by tension (e.g., tension-activated sheet material). Slits in the sheet material can be characterized as "simple slits" or "compound slits," where a "simple slit" is defined as having exactly two terminal ends and a "compound slit" has more than two terminal ends. In some embodiments, the tension-activated, expanding sheets include compound slits having more than two terminal ends, at least two slit segments, and at least one segment intersection.

The terms "coupled" or "connected" refer to elements attached to each other either directly (in direct contact with each other) or indirectly (having one or more elements between attaching the two elements). Either term may be replaced to "couplable" or "connectable" to describe that the elements are configured to be coupled or connected. In addition, either term may be modified by "operatively" and "operably," which may be used interchangeably, to describe that the coupling or connection is configured to allow the components to interact to carry out certain functionality.

The term "slidably coupled" refers to elements coupled in a manner that allows for slidable movement relative to one another.

The term "rotatably coupled" refers to elements coupled in a manner that allows for rotational movement of at least one element relative to one another.

The term "releasably coupled" refers to elements coupled in a manner that allows for at least one element to be selectively uncoupled from one another.

The present disclosure relates to a dispenser for sheet material rolls and, in particular, an adaptive dispenser for sheet material rolls of tension-activated, expandable sheet material. Tension-activated, expandable sheet material may also be described as sheet material having expandable slits. Sheet material having expandable slits may be described as slit paper sheet material.

Various existing dispensers are configured to increase resistance that is applied to the sheet material roll when a free end of sheet material is manually pulled so that the sheet material expands as the roll unwinds. However, the resistance provided by existing manual dispensers can be so high that unwinding the sheet material can tear the sheet material while dispensing and may require a user to provide a highly consistent pull force on the free end of sheet material to evenly expand the expandable-slit sheet material. Further, the full weight of the roll resting on a nip roller of some dispensers can create excessive nip force that squeezes roll material in the opposite direction of the applied tension force (e.g., in the draw direction). The cumulative effect of this squeezed material is the build-up of a free loop of material that eventually can cause a web handling error. Rolls of sheet material that are less tightly wound can exacerbate this issue. Further still, the weight of the roll varies as the sheet material is unrolled and consumed, which may cause undesirable inconsistency while unrolling the sheet material. Thus, this disclosure recognizes that it can be desirable to provide a dispenser that regulates pressure between a nip roller and the sheet material roll as the sheet material is unrolled and consumed.

The present disclosure provides an adaptive dispenser for a roll of sheet material having expandable slits and related methods of using the dispenser. The dispenser employs a technique that adapts to the varying weight and diameter of the roll as the sheet material is used and consumed to provide a sufficient amount of resistance to facilitate evenly deploying the expandable-slit sheet material. In particular, the dispenser may include an input roller movably and rotatably coupled to side support members that are configured to engage the roll in the loaded position. The input roller is configured to apply an input loading force onto the roll in a direction at least partially toward the loaded position. The direction of the input loading force may change as the roll is consumed and its diameter decreases. The dispenser may also include a drive system configured to couple rotation of the input roller and the output roller such that a velocity ratio of the output roller to the input roller is greater than 1.1 to expand slits in the sheet material.

Figure 2:
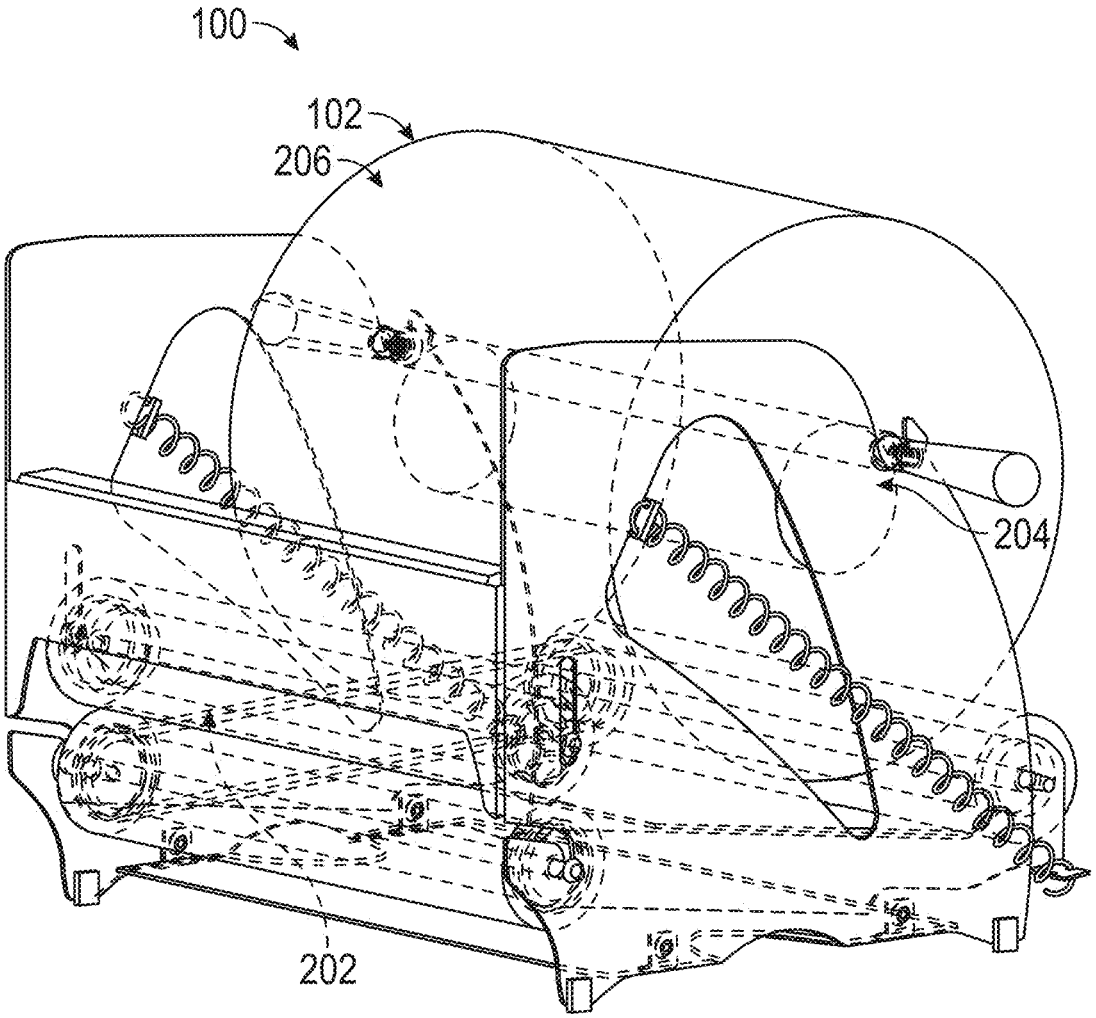
FIG. 2 illustrates a perspective view showing features of the dispenser not visible in FIG. 1.
Figure 3:
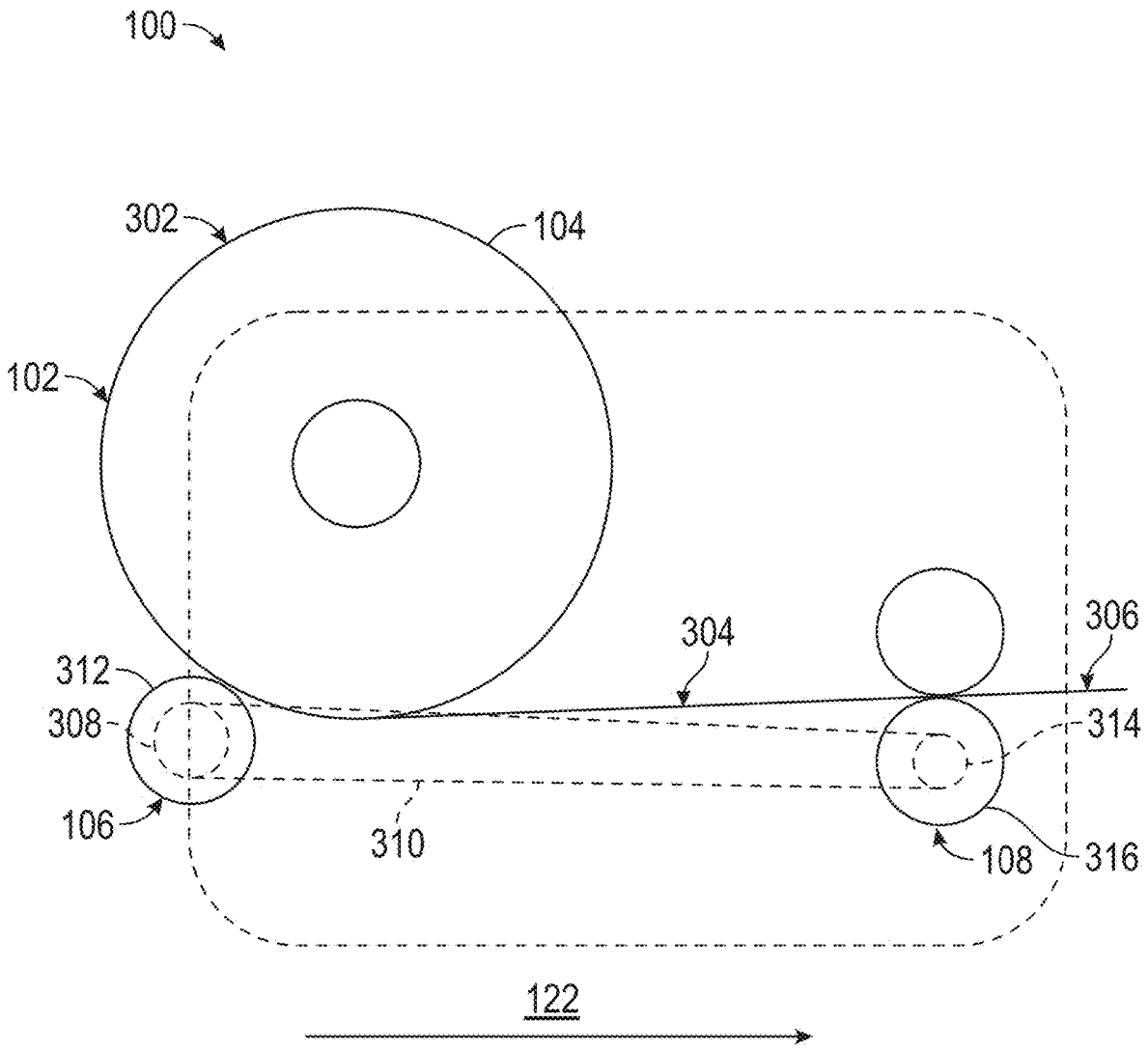
FIG. 3 illustrates a schematic elevation view of the dispenser of FIG. 1 deploying the sheet material.

FIG. 1 shows a perspective view of a dispenser 100 for use with a roll 102 of sheet material 104 according to the present disclosure. FIG. 2 shows a perspective view showing hidden features of the dispenser 100 not visible in FIG. 1. FIG. 3 shows a schematic elevation view of the dispenser 100 in use with the roll 102 to deploy the sheet material 104. In general, the dispenser 100 may include an input roller 106, an output roller 108, and side support members 112. When the sheet material 104 is unrolled and move across the input roller 106 toward the output roller 108 in a draw direction 122, the sheet material 104 is expanded and deployed.

The side support members 112 are configured to support the roll 102 and other components of the dispenser 100 above a surface, such as a table. The side support members 112 may be formed of any suitable material, which may be rigid, semi-rigid, or any combination of these, such as metal. The side support members 112 may be integrally formed from a single piece of material or formed from one or more materials or components coupled together.

The dispenser 100 may include a material support member 114. The material support member 114 is configured to engage the roll 102. In particular, the material support member 114 may engage an inner surface 204 (FIG. 2) of the roll 102. In some embodiments, the inner surface of the roll 102 is defined by the inner surface of a hollow core, which may be made of a different material than the sheet material 104. For example, the core may include a tubular member made of a rigid or semi-rigid material, such as cardboard or plastic. In other embodiments, the roll 102 has no core and the inner surface 204 of the roll 102 is defined by the sheet material 104 itself. In such cases, the roll 102 may be described as a coreless roll of sheet material 104. In some embodiments, the outer surface 206 of the roll 102 is defined by the sheet material 104.

In some embodiments, the inner surface of the roll 102 has an inner open diameter greater than an outer diameter of the material support member 114. For example, the inner open diameter of the roll 102 may be at least 1.25, 1.5, 2, 2.5, or even 3 times greater than the outer diameter of the material support member 114. Extra space created by the difference in diameters can facilitate the ease for a user to slide the material support member 114 through the inside diameter of the roll 102 and then use the material support member to lift the roll. This extra space also allows for handles or other coverings at the ends of the material support member 114 that facilitate ease or comfort for a user to hold and apply forces to the material support member.

The dispenser 100 may include one or more material support interfaces 118. In some embodiments, the side support members 112 may include a first side support member and a second side support member. Each of the side support members 112 may define a material support interface 118 configured to guide the material support member 114 to a loaded position 116. In some embodiments, the material support member 114 is a generally cylindrical elongate member, such as a rod or shaft. When the material support member 114 is in the loaded position 116, the lateral movement of the roll 102 orthogonal to the major axis of the material support member 114 may be restricted while being able to freely rotate about the material support member 114.

In some embodiments, the material support interfaces 118 may include a material support locking member 130. The material support locking member 130 may be configured to retain the material support member 114 in the loaded position 116. Any suitable technique may be used to retain the material support member 114. For example, the material support locking member 130 may include a latch or an indent in the side support member 112 to at least partially or fully close the opening of the slot.

In general, the material support interfaces 118 are shaped to guide the material support member 114 to a stable loaded position 116 with the assistance of gravity to facilitate rotation of the roll 102 and deployment of the sheet material 104. In the illustrated embodiment, the material support member 114 rests in a slot of the material support interface 118 in the loaded position 116. The inner surface 204 of the roll 102 may rest on or otherwise engage the material support member 114. In some embodiments, the material support interfaces 118 may be configured to allow the weight of the material support member 114 to provide a downward force on the roll 102 due to its weight.

Any suitable type of material support interface 118 may be used to guide the material support member 114 to the loaded position 116. In the illustrated embodiment, each material support interface 118 is formed as a slot in the main body of each side support member 112. The material support interfaces 118 may also cooperatively define one or more insertion positions 120, or locations along the interface where a user may position the material support member 114 to contact the side support members 112 to guide the material support member 114 to the loaded position 116. For example, in the illustrated embodiment, the insertion position 120 may extend from the sloped upper edge of each of the side support members 112 toward the opening of the slot. Once the material support member 114 is positioned anywhere along the sloped upper edge, the material support member 114 would be guided toward the loaded position 116 with the assistance of gravity.

The side support members 112 are spaced apart along a width axis orthogonal to the draw direction 122 to define a width along the width axis. The dispenser 102 may include one or more cross members coupled to the side support members 108 to facilitate their spacing. Collectively, the cross members and the side support members 112 may be described as a frame, or support frame, of the dispenser 100.

In some embodiments, the dispenser 100 is portable or nonfixed. When portable, the dispenser 100 may be particularly desirable for tabletop use with rolls 102 of any suitable weight up to 16 kilograms (kg), for example, less than or equal to 16, 14, 12, 10, 8, 6, 4, or even 2 kg. In some embodiments, the dispenser 100 may be more permanently secured to a location and constructed to handle larger rolls of material. In such cases, a crane or multiple persons may be required to load rolls of material weighing more than 16 kg.

The material support member 114 may be configured to extend concurrently through both material support interfaces 118 of the side support members 112. The width of the material support member 114 may be equal to or greater than the width of the dispenser 100. In some embodiments, the material support member 114 may extend beyond the dispenser width sufficiently to allow a user to hold both ends of the material support member 114 while loading a sheet material roll 102 into the dispenser 100. The material support member 114 may be releasably coupled to the side support members 112. For example, in the illustrated embodiment, the material support member 114 may be removed from the material support interface 118.

The input roller 106 is an elongate member extending along the width axis that may be rotatably coupled to the side support members 112. The input roller 106 is positioned to engage the roll 102 when the material support member 114 is in the loaded position 116. In particular, the input roller 106 may be movably positioned to engage the outer surface 206 of the roll 102. In some embodiments, the input roller 106 is movably and rotatably coupled to the side support members 112 to apply an input loading force onto the roll in a direction at least partially toward the loaded position, which is orthogonal to the width axis. The direction of the input loading force may be different than, or at an angle to, the draw direction 122. As the diameter of the roll 102 decreases with consumption of the sheet material 104, the direction of the input loading force may change (see FIG. 6, FIG. 7, and FIG. 8).

The output roller 108 is an elongate member extending along the width axis that may be rotatably coupled to the side support members 112. The output roller 108 is spaced from the input roller 106 along the draw direction 122. The output roller 108 is positioned to engage unrolled sheet material 104 from the extending from the input roller 106.

The dispenser 100 may include one or more output support interfaces 124. In some embodiments, each side support member 112 includes an output support interface 124 to engage the output roller 108. In general, the output support interfaces 124 allow the output roller 108 to freely rotate relative to the side support members 112. Each output support interface 124 may include a slot and an opening to allow the output roller 108 to be releasably coupled to the side support members 112 and easily inserted or removed into the slot. In some embodiments, the slot may be a curved shape. In some embodiments, the output support interface 124 may include a bearing element.

The dispenser 100 may include one or more input force members 128 coupled to the input roller 106 and at least one side support member 112. The input force members 128 are configured to apply a force on the input roller 106, which is configured to move the input roller 106 in a direction toward the loaded position 116. Any suitable type of passive energy storage element may be used for the input force member, such as extension springs, compression springs, torsional springs, or any combination of these. In some embodiments, the dispenser 100 includes two or any other even number of input force members 128, which may facilitate balancing the force applied to the input roller 106. Each input force member 128 may be coupled to a different side support member 112. In the illustrated embodiment, the dispenser 100 includes two coiled springs each coupled to a different end portion of the input roller 106. In some embodiments, the input force members 128 may be configured to provide a constant force or a force within a particular range over the various positions of the input roller 106, which may be transformed into an input loading force on the roll 102 by the arrangement of the components of the dispenser 100 described herein in more detail.

The dispenser 100 may include one or more support rollers, such as output support roller 110, that are elongate members extending along the width axis, which may be slidably coupled to the side support members 112. The support rollers may provide a supporting force on another roller, for example, due to their weight. In the illustrated embodiment, the output support roller 110 may provide a supporting force (e.g., downward force) on the sheet material 104 that passes between the output support roller 110 and the output roller 108. The supporting force may be directed at least partially toward the respective roller. The support rollers may also be rotatably coupled to the side support members 112. In particular, the support rollers may be freely rotatable relative to the side support members 112, which may facilitate rotation as the output roller 108 rotates. In some embodiments, the support rollers may be described as floating nip rollers. In some embodiments, the support rollers may be covered with bristles, foam, or other soft material to distribute the forces on the sheet material.

The dispenser 100 may include one or more support roller interfaces 126. In some embodiments, each side support member 112 includes a support roller interface 126 to engage the one or more support rollers. In general, the support roller interfaces 126 may allow the support rollers to slide and freely rotate relative to the side support members 112. Each support roller interface 126 may include a closed slot to allow the support roller to slide toward and away from the output roller 108. In some embodiments, the slot may be a straight shape. In other embodiments, the support roller interfaces 126 may include open slots to allow support rollers to be releasably coupled to the side support members 112 and easily inserted or removed into the slot. The support roller interfaces 126 may also include slots that allow the side support member to be temporarily disengaged from the output roller 108, for example to make it easier to feed material through the region between the support roller and the output roller.

Figure 4:
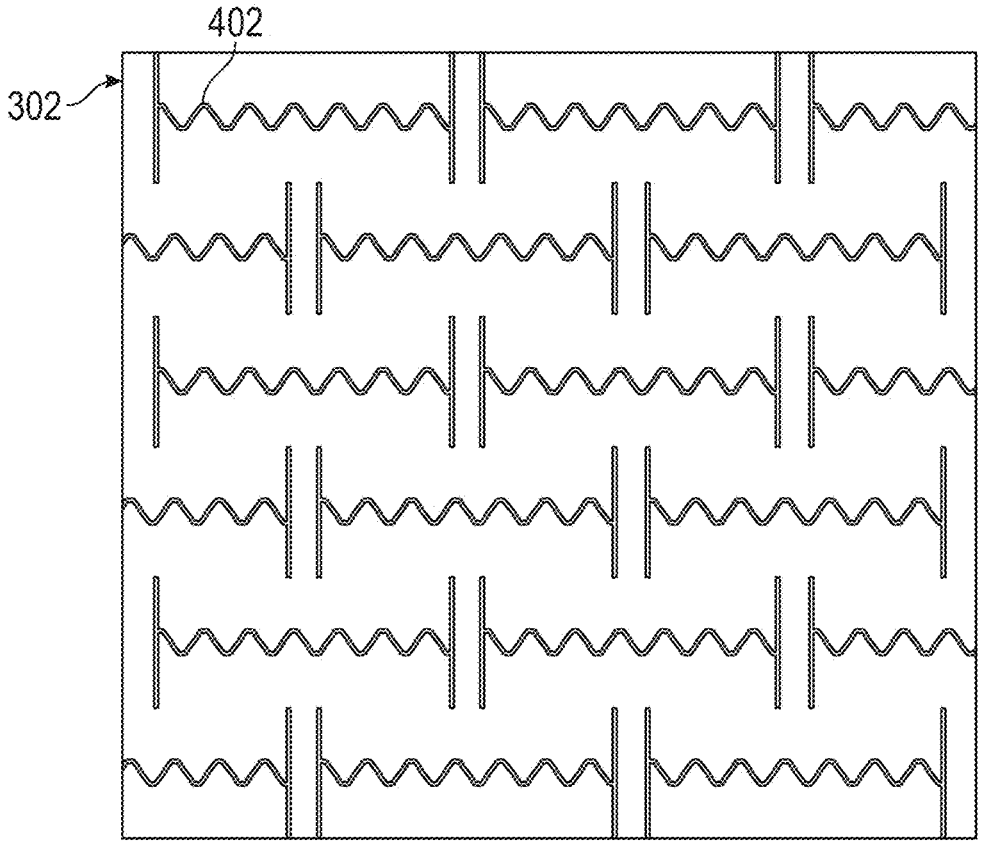
FIG. 4 illustrates a plan view of a portion of unexpanded sheet material including a plurality of slits in accordance with one embodiment and usable with the dispenser of FIG. 1.
Figure 5:
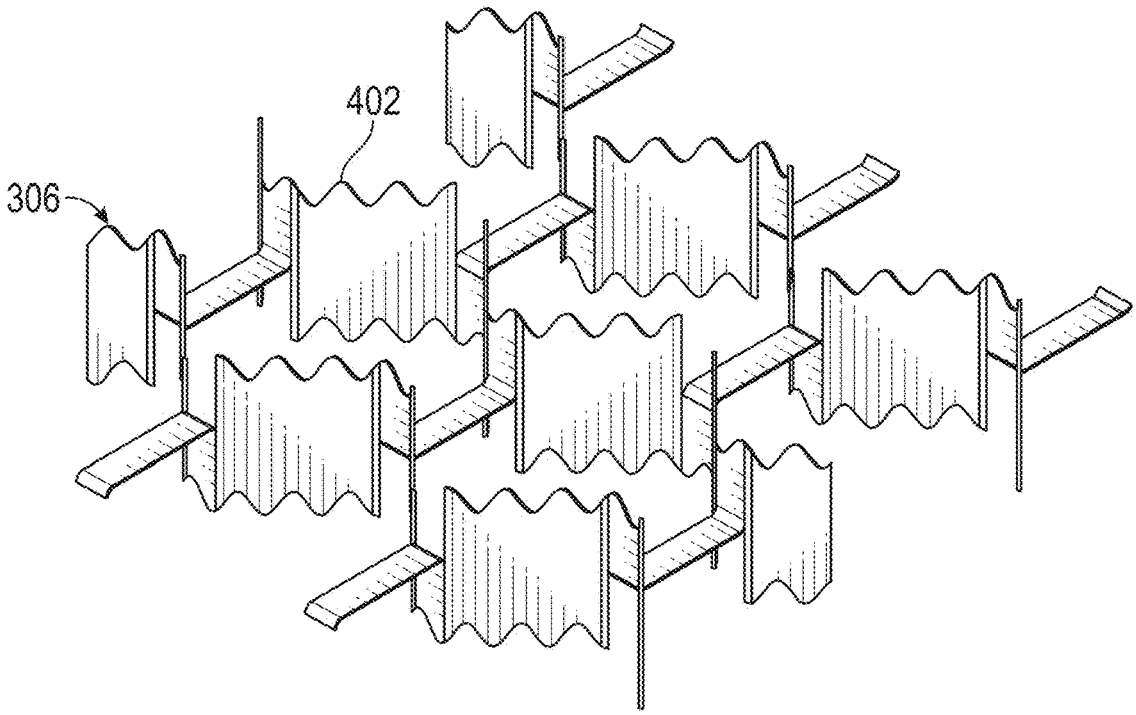
FIG. 5 illustrates a perspective view of a portion of expanded sheet material expanded from the sheet material of FIG. 4.

The sheet material 104 is shown in various forms in FIG. 3, including unexpanded sheet material 302 (undeployed sheet material), expanding sheet material 304 (deploying or partially deployed sheet material), and expanded sheet material 306 (deployed or fully deployed sheet material). Unexpanded sheet material 302 may also be described as undeployed sheet material in a flat configuration of the sheet material 104. FIG. 4 shows a plan view of one example of a portion of unexpanded sheet material 302 including a plurality of slits 402. Expanded sheet material 306 may also be described as deployed sheet material in a three-dimensional (3D) configuration of the sheet material 104. FIG. 5 shows a perspective view of one example of a portion of expanded sheet material 306 in which edges of regions of the sheet have been separated along the slits 402 (FIG. 4). Between the input roller 106 and the output roller 108, the sheet material 104 may be described as expanding sheet material 304. The input roller 106 and the output roller 108 apply a tension force on the sheet material 104 in the draw direction 122. When sheet material 104 moves in the draw direction 122 toward the output roller 108, the sheet material transitions from unexpanded sheet material 302 at (and upstream of) the input roller 106 to expanded sheet material 306 at (and downstream of) the output roller 108.

The sheet material 104 may also be described as being rolled or unrolled. Rolled sheet material is in contact with other layers of sheet material 104 of the roll 102. Unrolled sheet material is free of contact from other layers of sheet material 104 of the roll 102. The dispenser 100 is configured to unroll and expand the sheet material 104.

Various rollers of the dispenser 102, including the input roller 112, the output roller 114, and any support rollers, such as output support roller 110, may have any suitable shape or form to facilitate engaging and moving the sheet material 104 using rotary motion. The rollers have a generally cylindrical shape and may include one or more features to modulate the amount of engagement, or friction, with the sheet material 104. For example, one or more rollers may include a material engagement surface formed by a plurality of spaced apart wheels (or subrollers) connected by an axle, a cylindrical foam surface (e.g., a foam roller), a plurality of bristles configured to extend through slits in the sheet material 104 (e.g., a cylindrical bristle brush). In one example, each wheel of the spaced apart wheels may include a plurality of protrusions spaced around a circumference of the wheel to increase engagement with the sheet material 104. Any suitable material may be used for the wheel and the protrusions. In some embodiments, the protrusions may be made of a soft and somewhat tacky material (e.g., rubber). In other embodiments, the protrusions may be made of hard material (e.g., metal ridges). In some cases, use of the plurality of protrusions may mitigate developing slack in the sheet material 104 upstream of the input roller 106. In some cases, the plurality of protrusions includes points or edges that may engage or grip into the sheet material 104 configured to prevent slipping of the material across the surface of the roller.

These material engagement surfaces may be used with rolled or unrolled sheet material 104 that is deployed or undeployed. In general, the input roller 106 and the output roller 108 may be configured to have higher engagement with the sheet material 104 than any support rollers. In particular, the input roller 106 may be configured to have high engagement (e.g., a high frictional force with limited slip or no slip) with unexpanded sheet material 302, which may be rolled or unrolled, and the output roller 108 may be configured to have high engagement with expanding sheet material 304 or expanded sheet material 306. In one example, the input roller 106 may include a plurality of spaced apart wheels with each wheel having a plurality of protrusions spaced around the circumference. In another example, the input roller 106 may include one or more rigid cylindrical surfaces with groves cut into the surface to create protrusions. In another example, the output roller 108 may include a plurality of bristles configured to extend through slits in the sheet material 104. In yet another example, one or more support rollers may include a cylindrical foam surface. A person skilled in the art having the benefit of this disclosure would understand how to select such material engagement surfaces to provide the desired functionality for each type of roller.

In some embodiments, the dispenser 100 includes a drive system 202. In general, the drive system 202 is configured to couple rotation of the input roller 106 and the output roller 108 to provide a velocity ratio of output roller to input roller. As used herein, the term "velocity ratio" refers to a ratio the linear velocity as known to one skilled in the art, which describes the distance moved by one component in relation to the distance moved by another component, and may also be described as mechanical advantage. The velocity ratio may be defined as the linear distance of sheet material moved by the output roller 108 compared to the linear distance of sheet material 104 moved by the input roller 106 by rotating the coupled rollers. In general, a velocity ratio greater than 1 refers to more sheet material 104 passing the output roller 108 per unit of sheet material 104 passing the input roller 106. In some embodiments, the velocity ratio is greater than or equal to 1.1, 1.2, 1.3, 1.4, 1.5, 1.6, 1.7, 1.8, or even 1.9 to sufficiently expand slits in the sheet material 104. In some embodiments, the velocity ratio is less than or equal to 2.5, 2.4, 2.3, 2.2, 2.1, 2, 1.9, 1.8, 1.7, or even 1.6 to mitigate exceeding the tear force of the sheet material 104. In one or more embodiments, the velocity ratio is between 1.5 and 2.

In some embodiments, the drive system 202 includes a rotary transfer element 310, which may include one or more components, to couple rotation of the input roller 106 and output roller 108. Various components in the drive system 202 to facilitate coupled rotation at the velocity ratio may include belts, chains, gears, and pulleys.

In the illustrated embodiment, various circumferences of the input roller 106 and the output roller 108 cooperatively provide the velocity ratio. The generally cylindrical input roller 106 may include a drive element 308 having a first circumference coupled to the rotary transfer element 310 (such as a belt or chain) and a material engagement element 312 having a second circumference configured to engage the sheet material 104, and the generally cylindrical output roller 108 may include a drive element 314 having a third circumference coupled to the rotary transfer element 310 and a material engagement element 316 having a fourth circumference configured to engage sheet material 104. These circumferences may be selected to cooperatively provide the velocity ratio. In one example, the rotary transfer element 310 includes a belt or chain coupled to the drive elements of the input roller 106 and the output roller 108. The relative ratios of the first, second, third, and fourth circumferences (e.g., circumference ratios) may be selected to provide the desired velocity ratio.

The dispenser 100 may be configured to be manually powered, to use various amounts of powered assistance during operation, or to be fully motorized. In some embodiments, the dispenser 100 is configured to be manually powered by user pulling. In one example, a user may thread a free end of unrolled sheet material 104 extending downstream of the input roller 106 between the output roller 108 and the output support roller 110. The input roller 106 and the output roller 108 are configured to rotate in response to the user exerting a pull force in the draw direction 122 on the sheet material 104 downstream of the output roller 108.

For such manual configuration, the dispenser 100 may be configured to define a Minimum Pull Force Per Meter of sheet width to initiate rotation of the drive system 202. In some embodiments, the Minimum Pull Force Per Meter may be less than or equal to 75, 60, 45, 30, 15, or even 7.5 Newtons per meter (N/m). In one or more embodiments, the Minimum Pull Force Per Meter is less than or equal to 45 N/m. The definition of the Minimum Pull Force Per Meter is defined herein elsewhere. It is noted that choosing a larger diameter for the material engagement element 316 may increase the mechanical advantage of the input pull force and favorably reduce the Minimum Pull Force Per Meter for the dispenser 100.

The dispenser 100 may also include one or more user interfaces configured to accept user input to initiate rotation of the drive system 202. Such user interfaces may provide techniques for operating the dispenser 100 as an alternative, or in addition to, the user pulling on a free end of the sheet material 104.

The user interface may be unpowered. An unpowered user interface may be coupled to the drive system 202, for example, through the input roller 106, the output roller 108, or the rotary transfer element 310. The unpowered user interface may include any suitable mechanism to drive rotation of the drive system 202 in response to manual user power to unroll and deploy the sheet material 104. In some embodiments, the unpowered user interface includes a crank or pedal for the user to engage in any suitable manner. In one example, a hand crank may be coupled to the drive system 202. In another example, a foot pedal may be coupled to the drive system 202.

The drive system 202 may include one or more motors coupled to one or more of the input roller 106, output roller 108, and rotary transfer element 310. The motors may be configured to drive rotation of the drive system 202 in operation. The drive system 202 may include one or more controllers operatively coupled to the one or more motors. The controller may be configured to command the one or more motors to drive rotation of the input roller 106, output roller 108, and rotary transfer element 310. The components of the dispenser 100 may be powered in any suitable manner.

The user interface may be powered. A powered user interface may be operatively coupled to at least one controller, which is operatively coupled to at least one motor. The powered user interface may include any suitable components to accept user input to initiate rotation of the drive system 202, such as a button, pedal, other actuator, or touch screen. The controller may be configured to command the at least one motor to drive rotation of the drive system 202 in response to user input. In some embodiments, the rotation speed of the motor may be controlled by the powered user interface. In some embodiments, the motor may run continuously in response to user input or for a fixed time or distance based on a single user input command. The at least one motor is mechanically coupled to the rotary transfer element 310 by any suitable mechanism, such as a pulley. The rotation of the input roller 106 and the output roller 108 are coupled by the rotary transfer element 310. To operate the dispenser 100, a user may engage the powered user interface. In response, the drive system 202 rotates one or more of the input roller 106, output roller 108, and rotary transfer element 310 to move the sheet material 104 downstream along the draw direction 122 past the input roller 106 and the output roller 108 to provide expanded sheet material 306. Additionally, the user interface may be triggered externally by other automated systems that sense the requirements for producing a specific amount of expanded material at a specific time.

In other embodiments, the drive system 202 may include two motors. A first motor may be coupled to the input roller, and a second motor may be coupled to the output roller. The two motors may be capable of receiving separate commands from the one or more controllers. The one or more controllers be configured to power the two motors to provide the velocity ratio in response to user input. In such embodiments, the input roller 106 and the output roller 108 may not need a purely mechanical technique to couple their rotation (e.g., belt or chain). The rotary transfer element 310 may not be needed or, alternatively, the rotary transfer element 310 may be described as including the one or more controllers and two motors that provides an electromechanical technique to couple rotation of the input roller 106 and the output roller 108. One advantage of this system is the ability to change the velocity ratio, for example, based on a different type of expandable material.

The dispenser 100 may include at least one friction reduction element. The friction reduction element may be any suitable structure positioned between various components to facilitate movement between the components. Various examples of suitable friction reduction elements include bushings (e.g., bronze bushings), bearings (e.g. rolling element bearings), low friction tape (e.g., polytetrafluoroethylene tape), low friction plastic (e.g., ultra high molecular weight (UHMW) plastic). The friction reduction element may be described as being part of various components of the dispenser 100, such as the input roller 106, output roller 108, material support member 114, material support interfaces 118, output support roller 110, or side support members 112. In some embodiments, at least one friction reduction element is positioned between the side support members 112 and the input roller 106, the output roller 108, or both. In some embodiments, at least one friction reduction element is positioned between the side support members 112 and the material support member 114. In some embodiments, at least one friction reduction element is positioned between side support members 112 and the output support roller 110.

Figure 6:
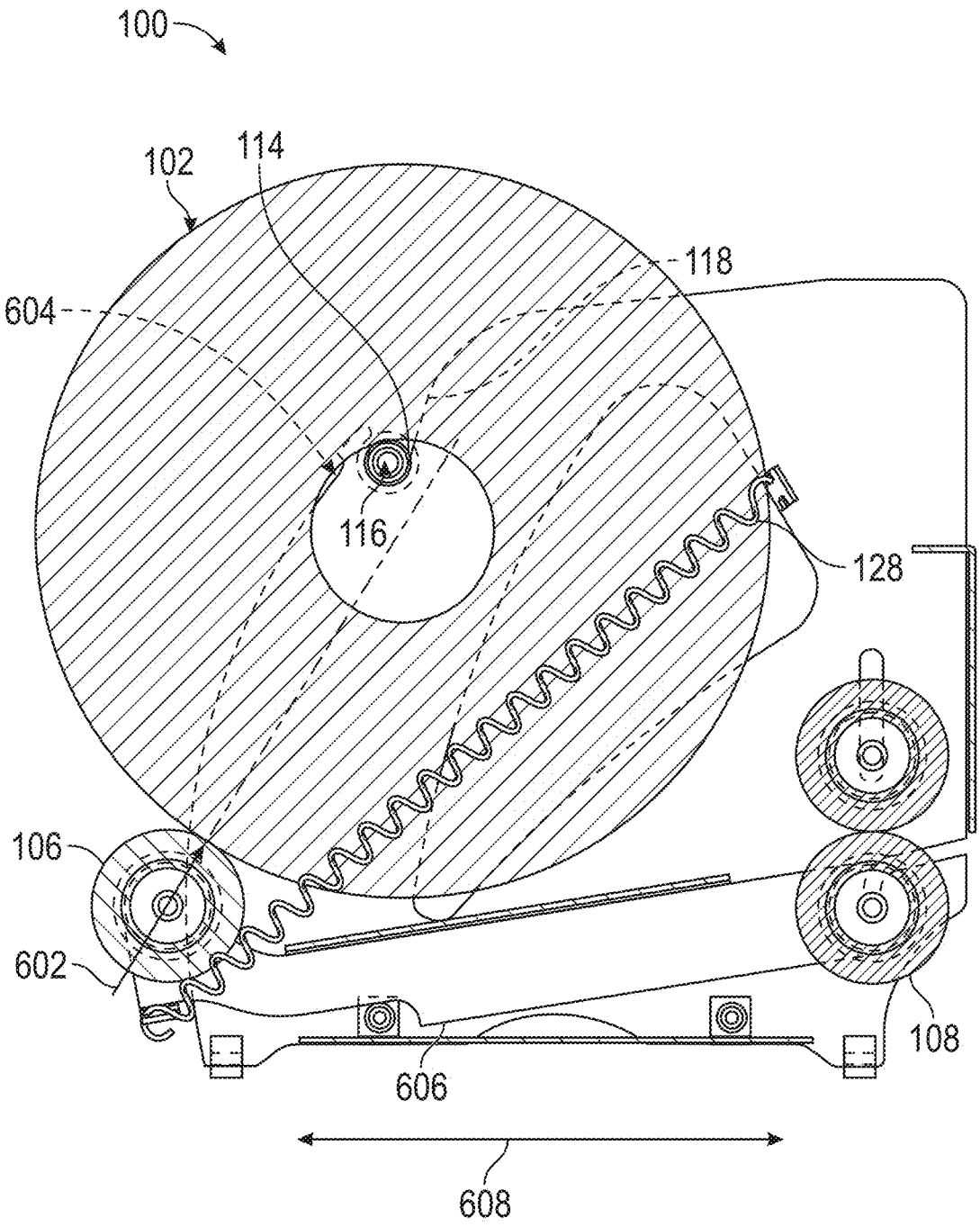
FIG. 6 illustrates a cross-sectional elevation view of the dispenser of FIG. 1 in a first position.
Figure 7:
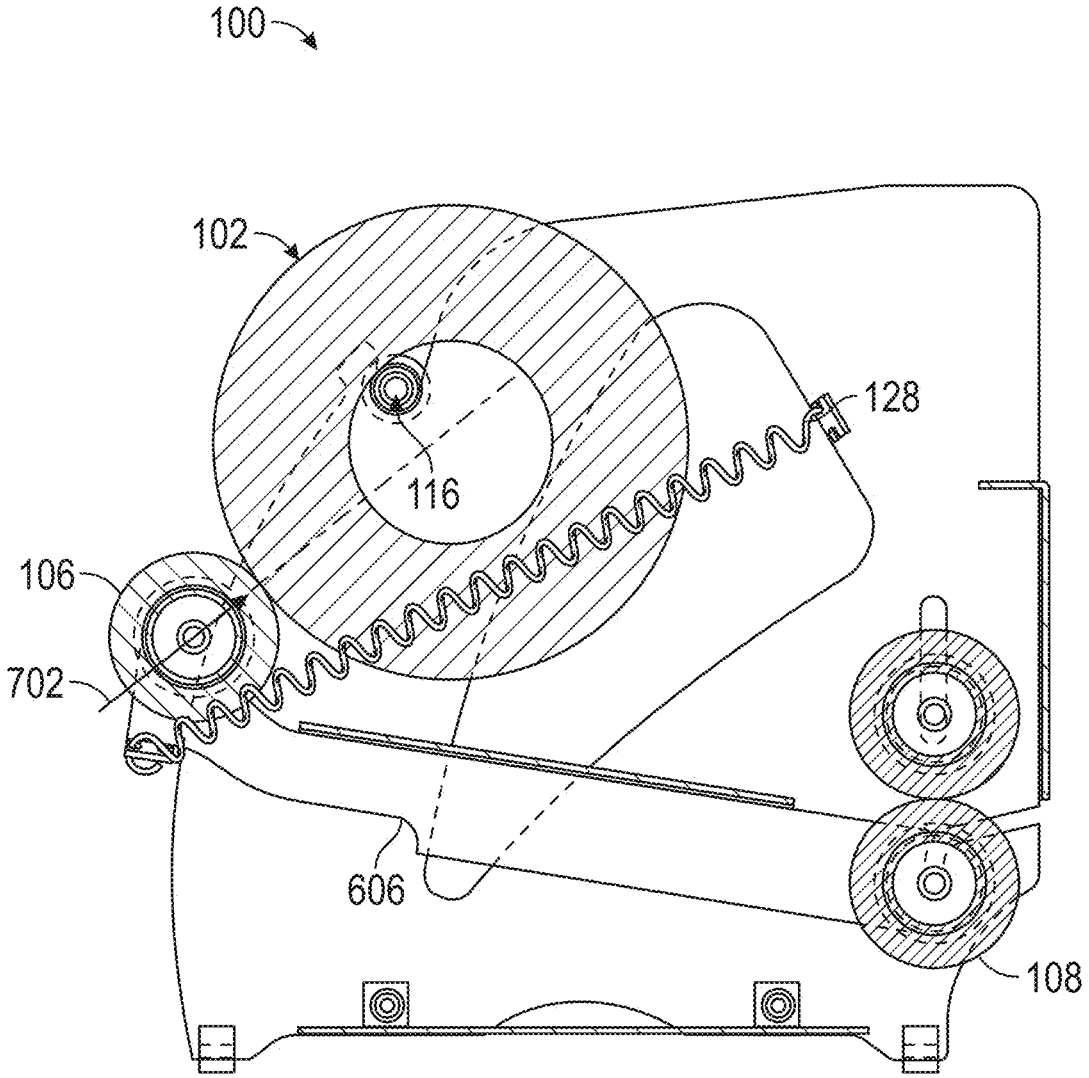
FIG. 7 illustrates a cross-sectional elevation view of the dispenser of FIG. 1 in a second position.
Figure 8:
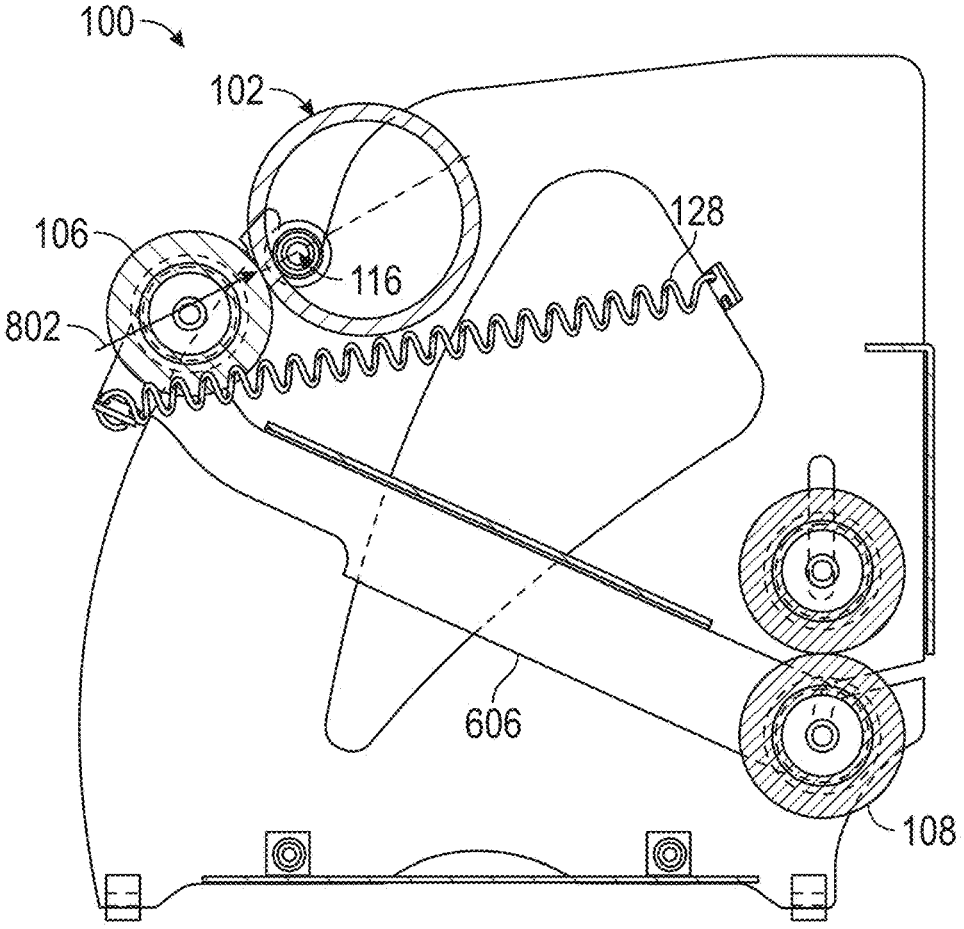
FIG. 8 illustrates a cross-sectional elevation view of the dispenser of FIG. 1 in a third position.

In some embodiments, the dispenser 100 is configured, or structured, to position the input roller 106 in at least three positions. The input roller 106 may move continuously from one position to another, particularly as the diameter of the roll 102 decreases. FIG. 6, FIG. 7, and FIG. 8 show various examples of positions of the input roller 106. The input roller 106 is configured to provide an input loading force that changes direction and amount of force as the diameter of the roll 102 decreases. The length axis 608 represents an imaginary line along the length of the dispenser 100.

The dispenser 100 may include one or more input roller guide members 606. Each input roller guide member 606 may be coupled between the input roller 106 and at least one side support member 112. The input roller guide member 606 may be configured to guide movement of the input roller 106 relative to the side support members 112. In some embodiments, the input roller guide member 606 includes a pivot arm. The pivot arm may be pivotally coupled to at least one side support member. The pivot arm may move the input roller 106 along an arcuate path. The pivot arm may pivot about the same axis as the output roller 108. The force applied by the input roller 106 to the roll 102 is facilitated cooperatively by the arrangement of the input roller guide member 606 (e.g., pivot arm) and the input force member 128 (e.g., coiled springs).

A radius of the arcuate path may be different than a distance from the output roller 108 to the loaded position 116 of the material support member 114. In some embodiments, the radius of the arcuate path is greater than the distance from the output roller 108 to the loaded position 116. In other embodiments, the radius of the arcuate path is less than the distance from the output roller 108 to the loaded position 116. The radius may be configured to change the angle of the input loading force as each input roller guide member 606 (e.g., pivot arm) moves toward the loaded position 116.

FIG. 6 shows a cross-sectional elevation view of the dispenser 100 in a first position with the roll 102 in a full, or unconsumed, state in a loaded position. In the first position, the input roller 106 is configured to apply a first input loading force 602 provided by the one or more input force members 128 onto the roll 102 in a first direction at least partially toward the loaded position 116. The length of the vector depicting the first input loading force 602 shows a magnitude of the first input loading force 602. A first angle may be defined between the first direction and a length axis 608 of the dispenser 100.

FIG. 7 shows a cross-sectional elevation view of the dispenser 100 in a second position with a partially consumed roll 102 of sheet material 104 in the loaded position. The diameter of the partially consumed roll is less than the full roll shown in FIG. 6. In the second position, the input roller 106 is configured to apply a second input loading force 702 provided by the one or more input force members 128 onto the roll 102 in a second direction at least partially toward the loaded position 116. The length of the vector depicting the second input loading force 702 shows a magnitude of the second input loading force 702, which may be similar to the first input loading force 602. A second angle may be defined between the second direction and the length axis 608, which may be less than the first angle.

FIG. 8 shows a cross-sectional elevation view of the dispenser 100 in a third position with an almost consumed roll 102 of sheet material 104 in the loaded position. The diameter of the almost consumed roll is less than the partially consumed roll shown in FIG. 7. In the third position, the input roller 106 is configured to apply a third input loading force 802 onto the roll 102 in a third direction at least partially toward the loaded position 116. The length of the vector depicting the third input loading force 802 shows a magnitude of the third input loading force 802, which may be similar to the second input loading force 702. A third angle may be defined between the third direction and the length axis 608, which may be less than the second angle.

The shallower angle of the input loading force from the input roller 106 on the roll 102 as the diameter of the roll 102 decreases may provide an appropriate amount of force to properly deploy the sheet material 104 without drastically changing the magnitude of the input loading force to accommodate the decreased weight of the roll 102. For example, when the roll 102 is almost consumed in FIG. 8, the angle of the third input loading force 802 is shallower such that the material support member 114 is less likely to be dislodged from the loaded position 116 by the input roller 106, due to the cooperative arrangement of the material support interfaces 118. While the material support member 114 rests on the material support interface 118 in the loaded position 116, the force between the input roller 106 and the roll 102 may be reliably controlled by the cooperation of the input force member 128 and the input roller guide member 606. In other embodiments, the input force member 128 and the input roller guide member 606 may be configured to provide a decreasing input loading force from the input roller 106 on the roll 102 as the diameter of the roll decreases.

The appropriate amount of input loading force may be determined based on various factors, such as the weight and diameter of the roll and properties of sheet material (e.g., tear force and Minimum Pull Force Per Meter). In some embodiments, the input loading force is less than or equal to 89 N, 67 N, 44 N, or even 22 N, for example, up to the weight of the material support member 114. In some embodiments, the input loading force may be relatively consistent over the range of motion of the input roller 106 and may vary less than +/−50% or even +/−25% from the average value of the input loading force across its range.

One advantage of the arrangement of the input loading force, as exemplified in FIG. 6, relates to the direction of the input loading force generally opposing the gravitational force of the roll of material as it is guided along the insert position 120. This oppositional force may reduce the force that the user exerts on the material support member 114 as the roll 102 of material is loaded. This reduced exertion can provide ergonomic benefits to users, in particular because the forces are reduced as the user can more easily reach farther out from their body to load the roll 102.

The dispenser 100 may include one or more input roller interfaces 604. The input roller interface 604 may be configured to limit movement of the input roller 106 in the direction toward the loaded position 116. The input roller interface 604 may prevent the input roller 106 from dislodging the material support member 114 from the loaded position 116, particularly when the roll 102 is almost or completely consumed. In some embodiments, the input roller interface 604 is formed from the side support members 112. In the illustrated embodiment, the input roller interfaces 604 include an outwardly curved protrusion on the exterior of each side support member 112.

Figure 9:
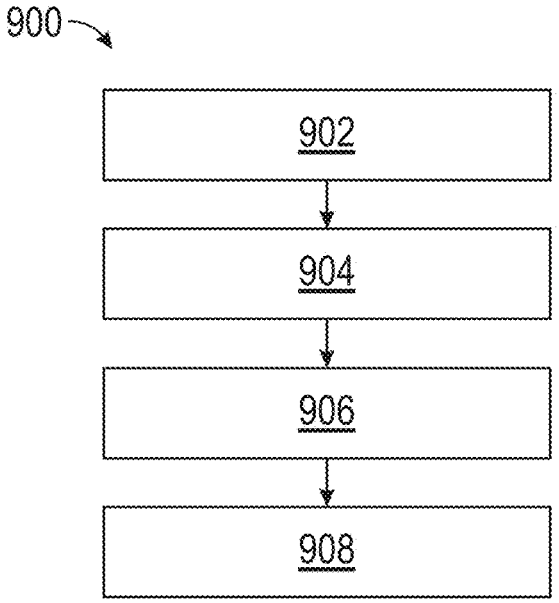
FIG. 9 illustrates a flowchart of a method of using the dispenser of FIG. 1 in accordance with one embodiment.

FIG. 9 is a flowchart showing one method 900 of using the dispenser 100 according to the present disclosure. The method 900 may be used to dispense a roll of sheet material having expandable slits. In block 902, a roll of sheet material may be disposed in a loaded position of the dispenser. In block 904, an input roller may be engaged with the roll of sheet material. In block 906, unrolled sheet material from the roll may be engaged with an output roller. In block 908, unrolled sheet material may be deployed into expanded sheet material.

As used herein, the term "Minimum Pull Force Per Meter" is defined as follows:

1. The Minimum Pull Force Per Meter can be thought of as the minimum tension per meter width of a sheet (the width being the dimension along the width direction orthogonal to the draw direction) that is required to unroll a roll of expandable sheet material that is at rest. In this disclosure, the minimum tension required to unwind a roll of expandable sheet material on a dispenser is determined by the following procedure:
2. Load the dispenser with a full roll of tension activated expandable sheet material. Any tape or adhesive that may be affixing the free end of the roll to the remainder of the roll must be removed.
3. To outside of the free end of the roll, attach a 15 #monofilament fishing line (such as that available under the trade name Berkley Trilene Super Strong) with tape, such as tape available from 3M Company (St. Paul, MN, USA) under the trade designation 3M 3939 Duct Tape. So long as the tape does not detach from the roll during the test and the combined mass of the tape and the fishing line is no more than 0.1% of the mass of the roll (e.g., for an 11 kg roll, the maximum combined mass of fishing line and mass of tape that may be used is 11 g), the precise nature of the tape will not alter the result beyond the experimental error. The attachment point of the fishing line to the roll should be within 5 cm of the end of the roll and in the center of the width of the roll. The tape is to be placed parallel (+/−5 degrees) to the free end of the roll, centered on the fishing line, and extending to at least 20% but no more than 90% of the width of the roll. The fishing line is then wrapped around the roll three times in the direction in which the roll is wound. The length of the fishing line must be sufficient to be wrapped around the roll as described in this step and to be configured as described in step 3, but the precise length will not appreciably alter the results so long as the combined mass requirements of the fishing line and tape, as described in this step, are met.
4. Route the free end of the fishing line so it can hang free straight down, in the direction of gravity. In certain configurations of the dispenser, it may be necessary to rest the dispenser on two surfaces with a gap between them to allow the fishing line to hang free and not be obstructed by the supporting surface. In certain configurations of the dispenser, it may be necessary to drill a hole in the bottom or base of the dispenser to allow the fishing line to hang free. If the fishing line does not hang straight down, an external pulley with very low friction is added so the fishing line can hang straight down. These or similar manipulations are valid and, when necessary to achieve the required position of the cable, required in this test.
5. Carefully and slowly attach a standard calibration weight to the free end of the cable such that the weights do not contact the roll, the dispenser, or any other surface. Add additional standard calibration weights in increments until the roll just starts to move.
6. The lowest weight that just starts the roll to turn is the minimum pull force. If the weights are standardized by their mass (e.g. g or kg) rather than weight (e.g., Newtons or pounds), then the minimum pull force is calculated by multiplying the mass by the gravitational constant.
7. Minimum Pull Force Per Meter is calculated by dividing the minimum pull force from step 5 by the width of the roll of expandable sheet material.

Thus, various embodiments of ADAPTIVE DISPENSER FOR EXPANDABLE SLIT SHEET MATERIAL are disclosed. Other features and combinations of features within the scope of this disclosure may be readily apparent to one skilled in the art having the benefit of the figures, descriptions, and claims.

Unless otherwise indicated, all numbers expressing feature sizes, amounts, and physical properties used in the specification and claims may be understood as being modified either by the term "exactly" or "about." Accordingly, unless indicated to the contrary, the numerical parameters set forth in the foregoing specification and attached claims are approximations that can vary depending upon the desired properties sought to be obtained by those skilled in the art utilizing the teachings disclosed herein or, for example, within typical ranges of experimental error.

The recitation of numerical ranges by endpoints includes all numbers subsumed within that range (e.g. 1 to 5 includes 1, 1.5, 2, 2.75, 3, 3.80, 4, and 5) and any range within that range. Herein, the terms "up to" or "no greater than" a number (e.g., up to 50) includes the number (e.g., 50), and the term "no less than" a number (e.g., no less than 5) includes the number (e.g., 5).

Terms related to orientation, such as "side" and "end," are used to describe relative positions of components and are not meant to limit the absolute orientation of the embodiments contemplated.

As used herein, the term "configured to" may be used interchangeably with the terms "adapted to" or "structured to" unless the content of this disclosure clearly dictates otherwise.

The singular forms "a," "an," and "the" encompass embodiments having plural referents unless its context clearly dictates otherwise.

The term "or" is generally employed in its inclusive sense, for example, to mean "and/or" unless the context clearly dictates otherwise. The term "and/or" means one or all of the listed elements or a combination of at least two of the listed elements.

What is claimed is:

1. A dispenser for a roll of sheet material having expandable slits, the dispenser comprising:

side support members including a first side support member and a second side support member spaced along a width axis, each defining a material support interface configured to guide a material support member to a loaded position;

an input roller movably and rotatably coupled to the side support members configured to engage the roll when the roll is mounted onto the material support member in the loaded position and configured to apply an input loading force onto the roll in a direction at least partially toward the loaded position;

an input roller: interface configured to limit movement of the input roller in the direction at least partially toward the loaded position;

an output roller rotatably coupled to the side support members, the output roller spaced from the input roller along a draw direction orthogonal to the width axis, the output roller positioned to engage unrolled sheet material from the roll extending from the input roller; and a drive system configured to couple rotation of the input roller and the output roller such that a velocity ratio of the output roller to the input roller is greater than 1.1 to expand slits in the sheet material.

2. The dispenser of claim 1, further comprising:

an output support roller slidably coupled to the side support members, the output support roller positioned to engage the unrolled sheet material when the unrolled sheet material is engaged with the output roller, the output support roller configured to apply a supporting force onto the unrolled sheet material at least partially toward the output roller, wherein the at least one roller support member is slidably movable relative to the side support members at least in a direction toward the output roller.

3. The dispenser of claim 1, further comprising:

an input force member coupled to the input roller and at least one side support member configured to apply a force on the input roller configured to move the input roller in the direction at least partially toward the loaded position.

4. The dispenser of claim 1, further comprising:

an input roller guide member coupled between the input roller and at least one side support member configured to guide movement of the input roller relative to the side support members.

5. The dispenser of claim 4, wherein the input roller guide member comprises a pivot arm pivotally coupled to the at least one side support member, the pivot arm configured to move the input roller along an arcuate path.

6. The dispenser of claim 5, wherein the pivot arm pivots about a same axis as the output roller.

7. The dispenser of claim 5, wherein a radius of the arcuate path is different than a distance from the output roller to the loaded position configured to change an angle of the input loading force as the pivot arm moves toward the loaded position.

8. The dispenser of claim 1, wherein the input loading force is less than or equal to 67 N.

9. The dispenser of claim 1, further comprising:

a material support locking member configured to retain the material support member in the loaded position.

10. The dispenser of claim 1, further comprising:

the roll, wherein material support member has an outer diameter and the roll has an inner open diameter at least 1.25 times greater than the outer diameter of the material support member.

11. The dispenser of claim 1, further comprising:

an output support roller configured to apply a loading force toward the output roller.

12. A method of dispensing a roll of sheet material having expandable slits, the method comprising:

disposing the roll of sheet material into the loaded position of the dispenser according to claim 1;

engaging the input roller with the roll of sheet material;

engaging unrolled sheet material with the output roller; and deploying unrolled sheet material into expanded sheet material.

13. A dispenser for a roll of sheet material having expandable slits, the dispenser comprising:

side support members including a first side support member and a second side support member spaced along a width axis, each defining a material support interface configured to guide a material support member to a loaded position;

an input roller movably and rotatably coupled to the side support members configured to engage the roll when the roll is mounted onto the material support member in the loaded position and configured to apply an input loading force onto the roll in a direction at least partially toward the loaded position;

an output roller rotatably coupled to the side support members, the output roller spaced from the input roller along a draw direction orthogonal to the width axis, the output roller positioned to engage unrolled sheet mater from the roll extending from the input roller;

a drive system configured to couple rotation of the input roller and the output roller such that a velocity ratio of the output roller to the input roller is greater than 11 to expand slits in the sheet material; and an input force member coupled to the input roller and at least one side support member configured to apply a force on the input roller configured to move the input roller in the direction at least partially toward the loaded position, wherein the input force member comprises two coiled springs each coupled to a different end portion of the input roller.

14. A dispenser for a roll of sheet material having expandable slits, the dispenser comprising:

side support members including a first side support member and a second side support member spaced along a width axis, each defining a material support interface configured to guide a material support member to a loaded position;

an input roller movably and rotatably coupled to the side support members configured to engage the roll when the roll is mounted onto the material support member in the loaded position; and an output roller rotatably coupled to the side support members, the output roller spaced from the input roller along a draw direction orthogonal to the width axis, the output roller positioned to engage unrolled sheet material from the roll extending from the input roller, wherein in a first position, the input roller is configured to apply a first input loading force onto the roll in a first direction at least partially toward the loaded position, the first direction at a first angle to a length axis, wherein in a second position, the input roller is configured to apply a second input loading force onto the roll in a second direction at least partially toward the loaded position, the second direction at a second angle to the length axis less than the first angle, wherein in a third position, the input roller is configured to apply a third input loading force onto the roll in a third direction at least partially toward the loaded position, the third direction at a third angle to the length axis less than the second angle.

* * * * *